US006531018B1

(12) United States Patent
Fiwek

(10) Patent No.: US 6,531,018 B1
(45) Date of Patent: Mar. 11, 2003

(54) METHOD AND DEVICE FOR DECORATING CONTAINERS

(75) Inventor: Wolfgang Fiwek, Wohltorf (DE)

(73) Assignee: Heineken Technical Services B.V., Zoeterwoude (NL)

( * ) Notice: Subject to any disclaimer, the term of this patent is extended or adjusted under 35 U.S.C. 154(b) by 0 days.

(21) Appl. No.: 09/402,706

(22) PCT Filed: Apr. 8, 1998

(86) PCT No.: PCT/DE98/00989

§ 371 (c)(1),
(2), (4) Date: Dec. 29, 1999

(87) PCT Pub. No.: WO98/45118

PCT Pub. Date: Oct. 15, 1998

(30) Foreign Application Priority Data

Apr. 10, 1997 (DE) ..... 197 14 794
Jan. 9, 1998 (DE) ..... 298 00 245

(51) Int. Cl.[7] ..... B44C 1/165

(52) U.S. Cl. ..... 156/238; 156/240; 156/542; 156/541; 156/540

(58) Field of Search ..... 156/230, 238, 156/240, 366, 367, 540, 541, 542, 358, 361, 363, 447, 456, DIG. 33, DIG. 27, DIG. 13, DIG. 14; 198/394

(56) References Cited

U.S. PATENT DOCUMENTS

| | | | | | |
|---|---|---|---|---|---|
| 4,992,129 | A | * | 2/1991 | Sasaki et al. | 156/240 |
| 5,201,984 | A | * | 4/1993 | Bedin | 156/566 |
| 5,650,028 | A | * | 7/1997 | Brandt et al. | 156/64 |
| 5,650,037 | A | * | 7/1997 | Larson | 156/540 |

FOREIGN PATENT DOCUMENTS

| | | | | |
|---|---|---|---|---|
| DE | 42 01 377 | C1 | 1/1992 | B41M/1/40 |
| DE | 44 32 018 | C2 | 9/1994 | B41M/5/38 |
| DE | 195 09 984 | C1 | 3/1995 | B41M/5/26 |
| FR | 2 691 671 | A1 | 5/1992 | B41F/17/18 |

* cited by examiner

*Primary Examiner*—Richard Crispino
*Assistant Examiner*—George R. Koch, III
(74) *Attorney, Agent, or Firm*—Young & Thompson

(57) ABSTRACT

A method and an apparatus is disclosed for decorating cylindrical and non-cylindrical containers by a continuous process. The containers (1) are decollated and rotated on a transport path (5) as well as stopped and secured using a marking (30) on the container (1). The containers (1) are set in rotation at the transfer location (11) and brought into contact with a pressure head (6, 6'). A contact line is formed between the carrier conveyor (10) for the decors and the rotating container (1) which moves with the container (1) over a predetermined path. The apparatus provides a novel positioning device (13) for the containers (1) and to two embodiments of a pressure head (6, 6').

13 Claims, 4 Drawing Sheets

METHOD AND DEVICE FOR DECORATING CONTAINERS

BACKGROUND OF THE INVENTION

1. Field of the Invention

The invention relates to a method and an apparatus for decorating containers.

2. Description of the Related Art

Containers of this type may be made of paper, plastic, glass or metal, and are mainly used in the beverage, food and cosmetic industry. Such containers are decorated by using transfer processes and corresponding devices.

Typically, containers have a cylindrical shape. Various methods and devices for decorating cylindrical containers are known. An exemplary method and an apparatus for a thermal transfer process is disclosed in DE 195 09 984 C1 (corresponding to U.S. Pat. No. 6,098,689). Herein, the containers move on a transport path while rotating, and decors move past a transfer location on a carrier conveyor, where the decors are transferred to the containers through application of pressure and heat. The transport path and the carrier conveyor move in opposite directions. The circumferential velocity of the containers corresponds to the velocity of the carrier conveyor, while the necessary transfer heat is produced by heating the carrier conveyor.

Unlike other known processes, the containers used with this process have a particularly high circumferential velocity which is determined by the opposing moving directions of the carrier conveyor and the transport path. This provides a continuous transfer at a high velocity and with excellent quality, because the spacing of the containers on the transport path and the spacing of the decors on the carrier conveyor can be independent of each other. In addition, the corresponding apparatus is much simpler because different movements do not have to be matched with each other.

However, the method and the apparatus disclosed in the reference are not suitable for decorating containers having a non-cylindrical shape. However, the industry uses more and more frequently containers, in particular PET bottles, having a particular shape in order to give the product a distinguishing characteristics. Until now, such containers could only be labeled or printed using discontinuously operating machines, which is an inefficient process that has been rejected by the industry in applications where large production quantities are required.

It is therefore an object to develop a process and an apparatus for continuously decorating cylindrical as well as non-cylindrical containers.

SUMMARY OF THE INVENTION

This object is solved by a method for decorating containers, wherein the containers (1) are moved on a transport path (5) and the decors are moved with a constant velocity on a carrier conveyor (10) in the opposite direction and tangentially at a transfer location (11), where the decors are transferred sequentially to the containers (1) by applying pressure and heat, and are subsequently subjected to a thermal treatment, wherein the ratio of the spacing of the containers (1) to the velocity of the transport path (5) is the same as of the ratio of the spacing of the decors to the velocity of the carrier conveyor (10) and wherein the containers (1) are accelerated in the region of the transfer location (11) to a circumferential velocity which corresponds to the velocity of the carrier conveyor (10), characterized in that before the transport location (11), the containers (1) are decollated to have a uniform spacing and are rotated and then stopped and secured in a predefined position based on a marking (30) on the container (1), the secured containers (1) are accelerated at the transfer location (11) to the required circumferential velocity, and a contact line between the carrier conveyor (10) and the rotating container (1) is established by a freely rotating transfer roll (26, 31) of a pressure head (6, 6') which moves with and is returned with the transport travel of the container (1) and can also be moved transversely to the transport path (5), wherein the contact line is maintained over a predetermined path of travel of the container (1) and by a device for decorating containers, comprising a transport path (5) for containers (1) having a uniform spacing and a carrier conveyor (10) for decorations having a uniform spacing, with the transport path (5) and the carrier conveyor (10) contacting each other with opposite rotation directions at a transfer location (11), wherein a pressure head (6) for applying a pressure to the transport path (10) towards the container (1) is arranged at the transfer location (11) and the transport path (5) includes a thermal post-treatment device (7) located after the transfer location (11) and the carrier conveyor (10) includes a heating device located before the transfer location (11), characterized in that the transport path (5) comprises a rotatable receiving device (22), which secures the position, and a positioning device (13), wherein the positioning device (13) is provided with a rotary drive and a position detent (16) which matches a marking (30) on the container (1) and interrupts the rotation of the container (1), and each receiving device (22) is designed so it can be driven together with the container (1) at the transfer location (11) in the direction on the carrier conveyor (10), and the pressure head (6) is provided with a pressure-biased movable transfer roller (26, 31), wherein the transfer roller (26, 31) is constructed so as to be able to rotate and travel with the container (1), and to move transversely to the transport travel of the containers (1).

Various preferred features of the present method are as follows:

the rotation for orienting and securing the container (1) is provided by a separate drive and is stopped at a predetermined position;

a cylindrical portion of the freely rotating container (1) rolls on a stationary friction element (15) over a predetermined rotation angle;

the containers (1) are oriented and secured on a feed star arranged before the carousel (4) and that the secured containers (1) are conveyed to the rotatable receiving devices (22) of the carousel (4), where the secured containers (1) are again secured in their respective position;

the containers (1) are secured on the carousel (4) by a friction force and each receiving device (22) is driven by the carrier conveyor (10) against the friction force in the region of the transfer location (11);

the receiving devices (22) are supported by a separate drive unit and that each receiving device (22) is rotated by this drive unit in the region of the transfer location (11);

the transfer roller (26, 31) is returned to its initial position by a linear motion after a label has been applied to a container (1);

the transfer roller (26, 31), after application of a label to a container (1), is returned to its initial position by a rotating motion about a pivot located outside the carousel 4;

to compensate for the different circumferential velocity of the container (1), the rotation of the container (1) or the transport motion of the carrier conveyor (10) has a non-uniform velocity which matches the circumferential contour of the container; and to compensate for a different circumferential velocity of the container (1), the decors on the carrier conveyor (10) have a distortion which is matched to the circumferential contour of the container (1).

Various preferred features of the device according to the invention are as follows:

a drivable feed star (2) is located before the carousel (4), wherein the positioning device (13) is arranged on the feed star (2) and the receiving device (22) is arranged on the carousel (4), and that both are functionally connected at a transfer location;

the rotational drive of the positioning device (13) comprises a receiving pocket (14) in the star (12) of the feed star (2) and a stationary friction element (15), both being dimensioned and arranged so as to match a cylindrical portion of the container (1);

the positioning device (13) comprises a position detent (60) which is rotatably supported in the star (12) of the feed star (2), with the position detent (16) having a drivable roller (18) and a positioning finger (20) which matches the marking (30) of the container (1) and a spring arrangement (21) acting towards the center of the container (1);

the receiving device (22) comprises a rotatable and drivable receiving plate (23) having a surface which matches the bottom contour of the container (1) and a centering head (24) which acts on the opening of the container (1);

the centering head (24) of the receiving device (22) includes a supply channel (25) for blast air which produces a counter-pressure in the container (1);

the carrier conveyor (10) for the decor is designed to form a drive for the receiving device (22);

the pressure head (6) is designed so that it can rotate and be driven in the direction of the transport travel of the container (1) and has at least three transfer rollers (26) which are each supported above a piston cylinder unit (28) at a pivot point located outside the carousel (4) and connected to each other via articulated arms (27), wherein the spacing between the transfer rollers (26) corresponds to the spacing between the containers (1) on the transport path (5);

four transfer rollers (26) are combined to form a movable parallelogram;

the transfer roller (26) which contributes to the transfer, is biased by a stationary cam having a shape which complements the contour of the container;

the articulated arms (27) are in the form of heating plates for the carrier conveyor (10);

the pressure head (6') can rotate and be driven in the direction of the transport motion of the container (1) and that the transfer rollers (31) are arranged on a circular track of the pressure head (6) and are operatively connected with a pressing unit (33), wherein the pressing unit (33) can be pivoted about a pivot point (34) located outside the rotation axis of the pressure head (6') and is supported for radial displacement relative to a rail (35) which can be pivoted about this pivot point (34), and the pivoting and displacement motion have separate drives in the contact region with the container (1);

the pressing unit (33) is driven by a cam gear to provide the pivot motion and the displacement motion for adjusting the circular path of the transfer roller (31) and that the pressing unit (33) is driven by a pressure medium in order for the displacement motion to adapt to the surface contour of the container (1);

the pressing unit (33) is a piston-cylinder unit;

with each transfer roller (31) there is associated a pressing unit (33) which rotates together with the pressure head (6');

a stationary pressing unit (33) is associated with all transfer rollers (31), wherein the stationary pressing unit (33) is constructed to be drivable in the contact region by the rotating motion of the rotating pressure head (6') so as to move together with the transport motion of the container (1), and the stationary pressing unit (33) has a separate drive for the return travel; and the transfer rollers (16) are spaced apart on the annular path of the pressure head (6') by retaining elements (32) which are also formed as a guide element and optionally as a heating element for the carrier conveyor (10).

This solution eliminates the disadvantages of conventional methods and devices.

It is particular advantageous that cylindrical as well as non-cylindrical containers can be decorated by a continuous process, without foregoing the advantages of the conventional methods for decorating of cylindrical containers.

A particularly important feature is the pressure head which is disclosed in two different embodiments. It is particularly advantageous with non-cylindrical containers if the pressure head, which has rotating rollers and a pressing unit, is implemented in the form of a piston-cylinder unit. In this way, uniform force components are produced at the transfer location, thereby preventing a distortion of the decor.

To reduce costs and complexity, the support elements arranged between the transfer rollers also operate as a guide path for the support conveyor and as heating elements.

Embodiments of a method and a corresponding apparatus of the invention will now be described.

DETAILED DESCRIPTION OF A PREFERRED EMBODIMENT

Figure 1:
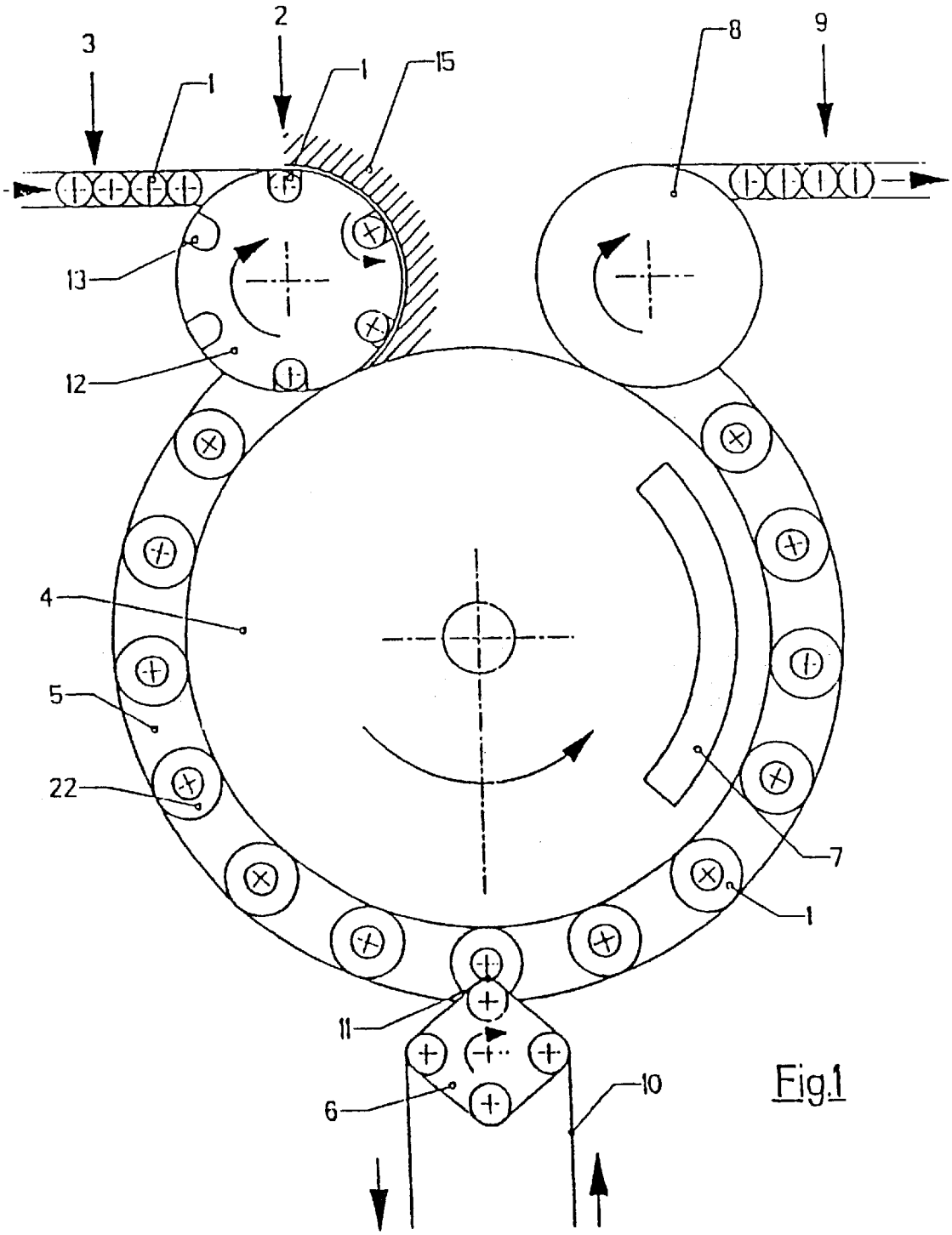
FIG. 1 shows schematically an apparatus for decorating containers.

Referring now to FIG. 1, the apparatus for decorating containers 1 consists essentially of a feed star 2 with a feed conveyor 3, a carousel 4 with a transport path 5, a rotating pressure head 6, a thermal post-treatment unit 7, a discharge star 8 with a discharge conveyor 9 and a carrier conveyor 10 holding the decors to be transferred, wherein the feed star 2, the rotating pressure head 6, the thermal post-treatment unit 7 and the discharge star 8 are arranged on the periphery of the carousel 4 and wherein the transport path 5 and the carrier conveyor 10 move in opposite directions and contact each other tangentially at a transfer location 11.

Figure 2:
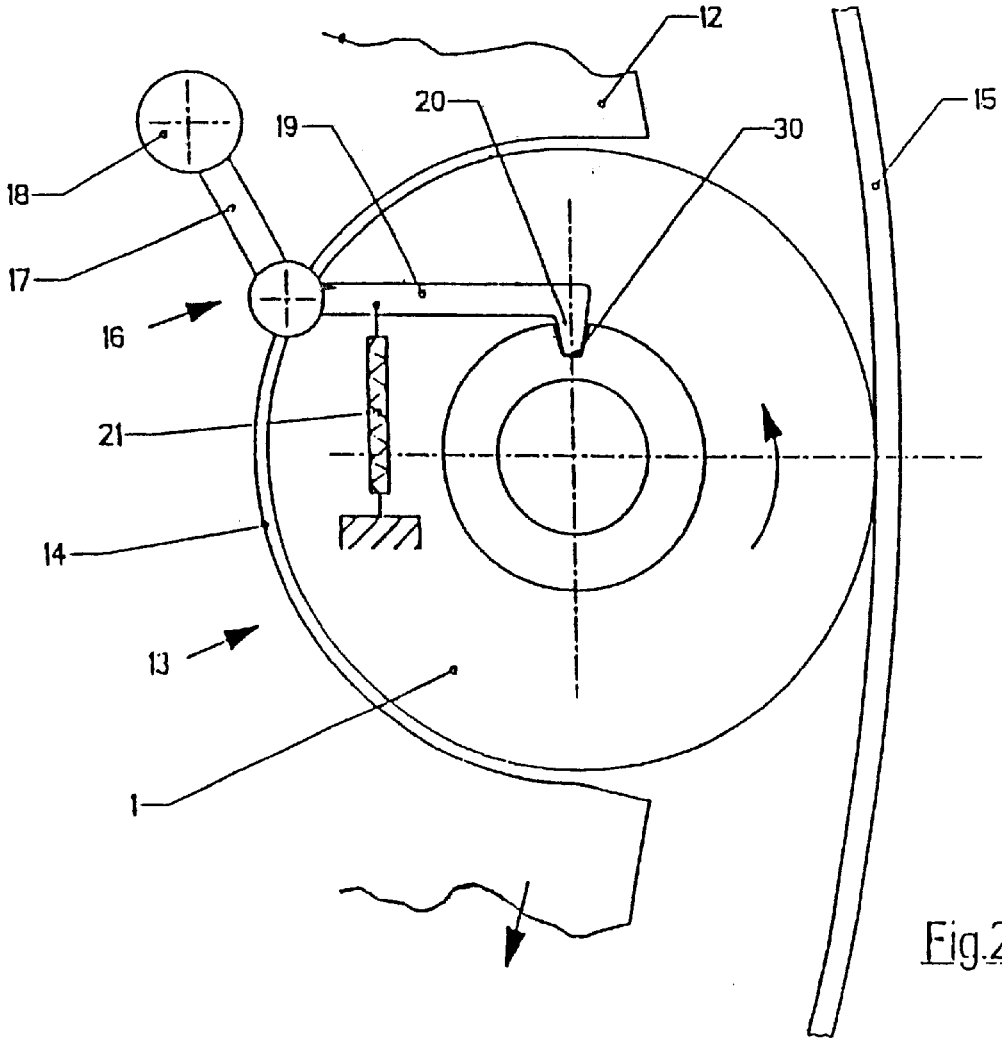
FIG. 2 shows a positioning device for a container.

Referring now to FIG. 2, the feed star 2 includes a rotatable and driveable star 12 with positioning devices 13 for the containers 1 which are uniformly distributed about the circumference. Each positioning device 13 has a receiving pocket 14, which is formed in the star 12 and whose dimension matches that of a cylindrical portion of the container 1. A stationary friction element 15 is placed in an outer region of the star 12, so that the cylindrical portion of the container 1 is in continuous contact with the friction element 15 over a predetermined rotation angle of the star 12.

Each positioning device 13 is also provided with a position detent 16 which is pivotally supported and controlled by a cam. The position detent 16 has a lever arm 17 with a roller 18 and another lever arm 19 with a positioning finger 20. A spring device 21 retains the positioning finger 20 in an initial position proximate to the center of the receiving pocket 14.

Figure 3:
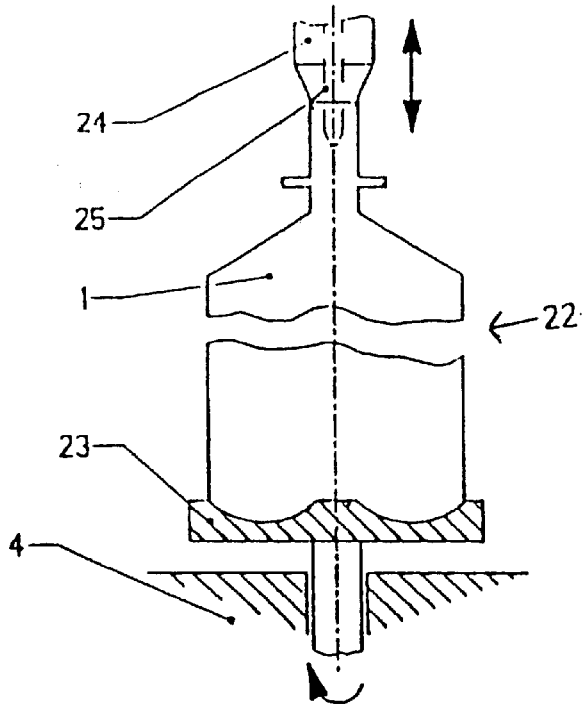
FIG. 3 shows a receiving device for the container on a carousel.

The carousel 4 is provided with receiving devices 22 for the containers 1 which are uniformly spaced about the circumference, as illustrated in FIG. 3.

Each receiving device 22 consists of a rotatable receiving plate 23 with a support surface that matches the shape of the bottom of the container 1, and a centering head 24 which is controlled by a cam and movable in a linear direction and has a supply channel 25 for the blast air which produces a counter-pressure in the container 1. The centering head 24 is preferably conical and matched to the size of the container opening. The rotatable receiving plate 23 may be freely rotatable or driveable in a direction opposite to the rotation direction of the carousel 4.

The rotating pressure head 6 is arranged in the processing line between the feed star 2 and the discharge star 8. Two embodiments are proposed for the pressure head 6.

Figure 4:
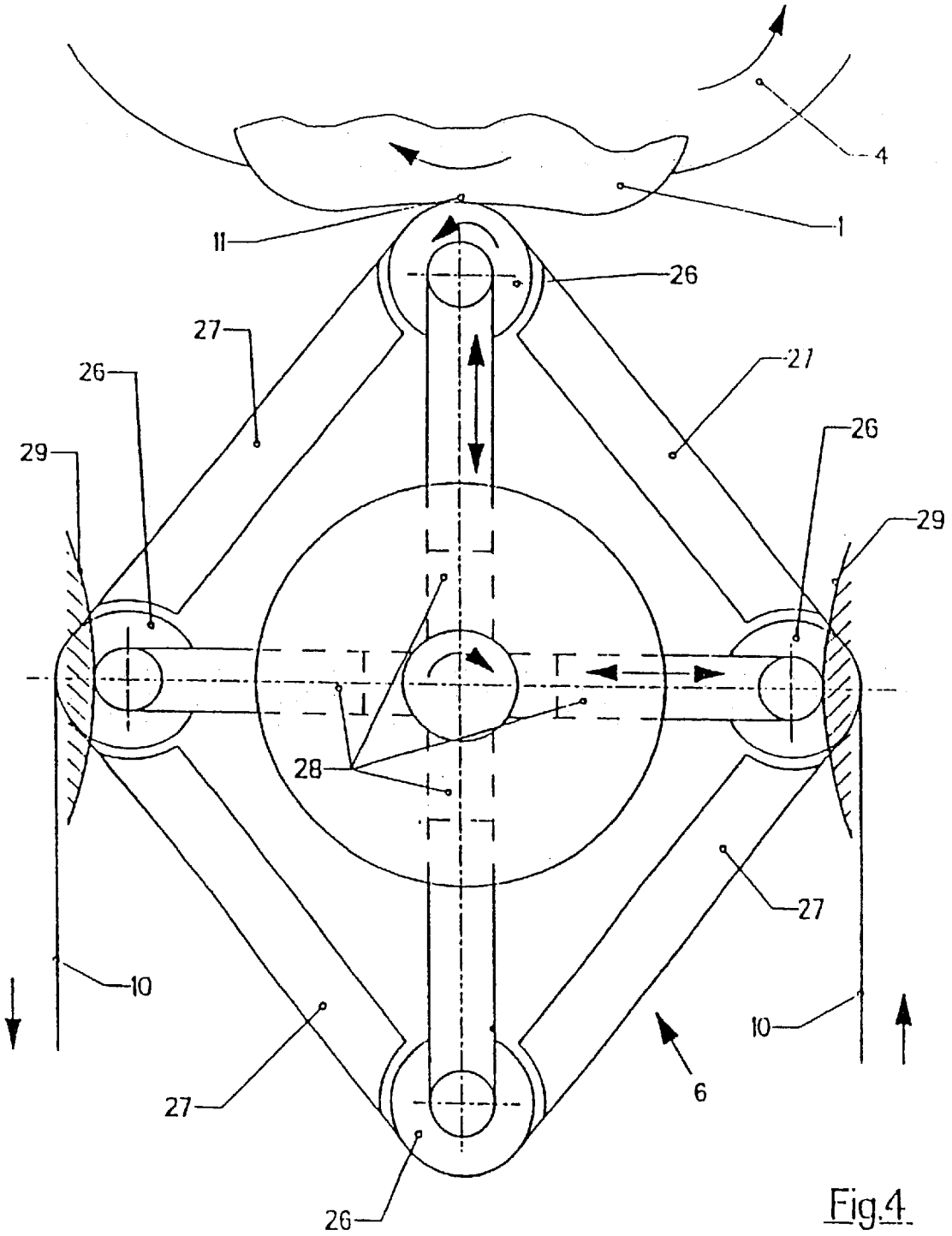
FIG. 4 shows a first embodiment of a rotating pressure head.

A first embodiment is illustrated in FIG. 4. The rotating pressure head 6 is shown as being rotatably supported, drivable and consisting of four freely rotatable transfer rollers 26 which are connected with each other via articulated arms 27, forming an articulated parallelogram. All transfer rollers 26 are in addition guided in piston-cylinder units 28 arranged in the form of a cross and supported at the center. The pressure head 6 is designed so that the four transfer rollers 26 have the same separation from each other as the containers 1 on the carousel 4, with one of the transfer rollers 26 always positioned in the contact region of the container 1. The two opposite transfer rollers 26 which enclose the transfer roller 26 that are currently located in contact region of the container 1, are each contacted by stationary, spring-biased cams 29. The spring force of these cams 29 determines the contact pressure on the transfer roller 26 which currently contacts the container 1. The shape of the cams 29 complements the shape of the container 1 to be printed. An adjustment device which limits the movement of a transfer roller 26 and also the excursion of the entire parallelogram, is not shown.

Figure 5:
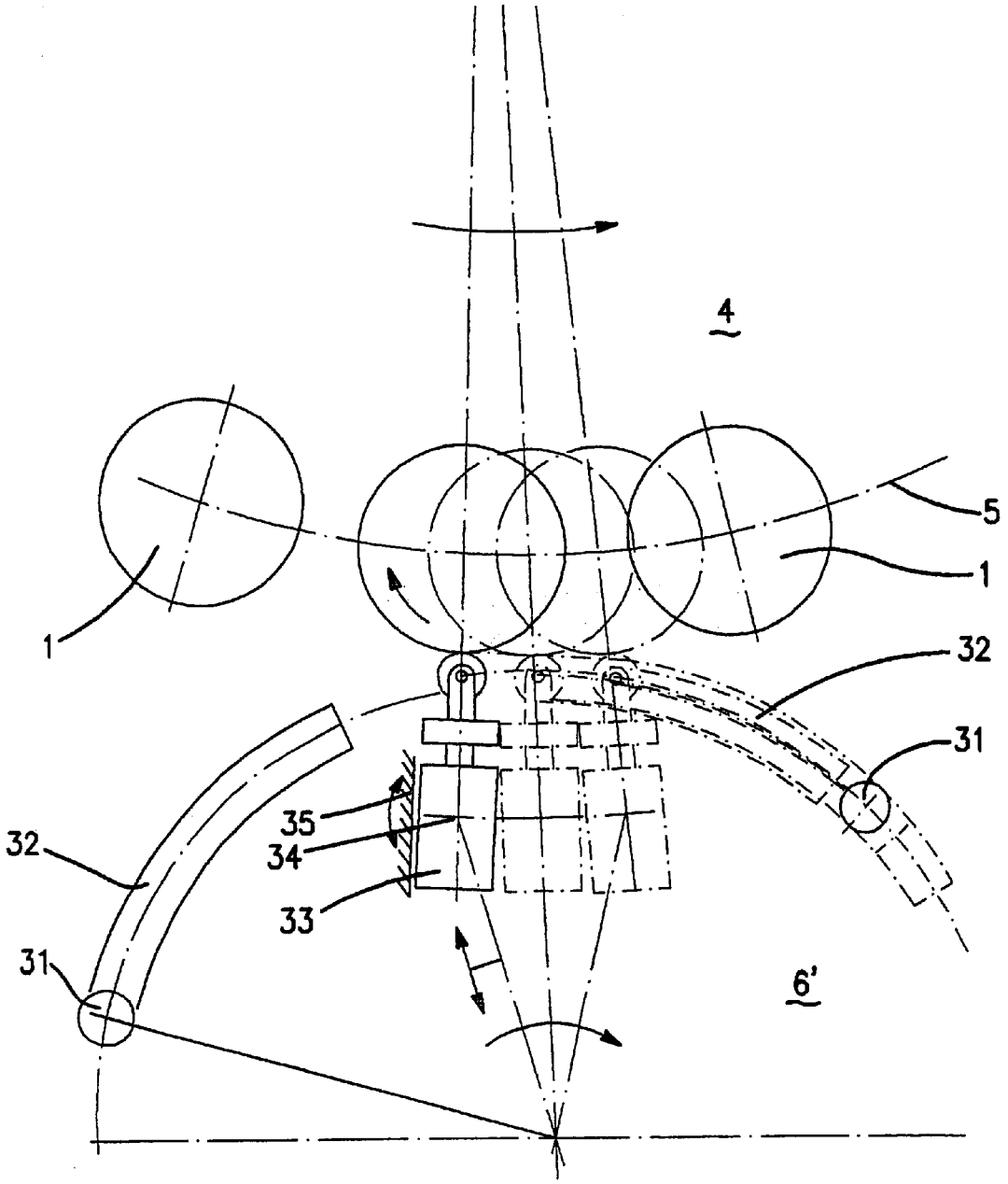
FIG. 5 shows a second embodiment of a rotating pressure head.

A second embodiment is illustrated in FIG. 5.

In this embodiment, the rotating pressure head 6' is also rotatably supported and drivable, but has several transfer rollers 31 which are uniformly arranged on a circular path. The spacing of these transfer rollers 31 corresponds to the spacing of the containers 1 on the transport path 5. Retaining elements 32 which maintain the spacing between the transfer rollers 31 and also guide the carrier conveyor 10, are arranged between the transfer rollers 31. The retaining elements 32 can also operate as heating elements for heating the carrier conveyor 10.

Each transfer roller 31 is associated with a pressing unit 33 located inside the pressure head 6'. The pressing unit 33 is preferably a piston-cylinder unit, wherein the piston is operatively connected with a transfer roller 31 and the cylinder is supported for rotation about a pivoting point 34 located outside the rotation axis of the pressure head 6' and for radial displacement relative to a rail 35 which can pivot about the pivoting point 34.

When arranged and supported in this fashion, the piston-cylinder unit can execute three different movements. Initially, the piston moves in a radial direction and pushes the respective transfer roller 31 out of the circular path of the rotating pressure head 6' into a circular path parallel to the transport path 5. This translation is driven by a first cam control.

The entire piston-cylinder unit then rotates about the pivoting point 34 while moving the piston always in a direction perpendicular to the container 1. This rotation motion is driven by a second cam control.

The piston of the piston-cylinder unit also move radially, following the surface contour of the rotating container. If the containers 1 have a cylindrical shape, then such radial movement is unnecessary. If the containers 1 have a non-cylindrical shape, then the radial movement of the piston corresponds to half the difference in the container's major diameters. This radial displacement is preferably actuated by pneumatic pressure.

The pressing unit 33 is always oriented perpendicular to the surface of the container 1.

A carrier conveyor 10 is positioned around the rotating pressure head 6, 6'. The carrier conveyor 10 also extends over a several transfer rollers 26, 31 and is the driven separately opposite to the rotation direction of the carousel 4 with a velocity corresponding to the circumferential velocity of the containers 1.

The decors to be transferred are arranged on the carrier conveyor 10 at a predetermined uniform spacing. The ratio of the spacing of the decor to the velocity of the carrier conveyor 10 is the same as the ratio of the spacing of the containers 1 to the velocity of the transport path 5 on the carousel 4. To provide a predetermined contact time between the active transfer rollers 26, 31 and the container 1 over a predetermined common path, the circumferential velocity of the transport path 5 has to be identical to the circumferential velocity of the pressure head 6, 6'.

Not illustrated are heating jaws or heating rollers located in the region of the carrier conveyor 10 and arranged before the transfer roller 26, 31 in the transport direction for heating the decor to the required transfer temperature. Advantageously, the articulated arms 27 or the retaining elements 32 of the pressure head 6, 6', respectively, may be formed as heating jaws.

A thermal post-treatment unit 7 is arranged in the processing direction of the transport path 5 after the pressure head 6, 6'. The post-treatment unit 7 can operate according to a conventional roll-off process or a hot air process and may therefore be include a revolving heated blanket roller or a heated plate on which the containers 1 roll off, or a revolving hot air nozzle.

The operation of the apparatus for decorating containers requires that each container 1 has a cylindrical portion with a marking 30. The marking 30 may be an indentation, for example a notch, or a raised portion, for example a bead, which may be arranged on the circumference or on one of the end faces of the cylindrical portion of the container 1.

For applying decorations, the containers are initially supplied to the feed star 2 via a feed conveyor 3 and arranged by a worm (not shown) with a spacing which corresponds to the spacing of the star. The driven feed star 2 which rotates in the same direction, takes up the individual containers 1 in such a way that one container 1 is associated with each receiving pocket 14. Each position detent 16 which is controlled by a cam, initially assumes preferably an open position in which the positioning finger 20 is distal from the center of the receiving pocket 14. When the star 12 rotates, each container 1 moves past the stationary friction element 15 whereby a cylindrical portion of the container is brought into contact with the friction drive 15. At the same time, the roller 18 of the position detent 16 is released by the cam, whereby the force of the spring device 21 moves the position detent 16 towards the center of the receiving pocket 14. The friction force produced by the friction element 15 causes the container 1 to rotate until the positioning finger 20 catches a marking 30 of the container 1, thereby interrupting the rotating motion of the container 1. The position detent 16 is locked in this position by the cam.

The position of the container 1 is thereby aligned.

The aligned containers 1 are subsequently successively transferred to the receiving devices 22 of the carousel 4 by placing each container 1 on the rotatable, but initially stationary receiving plate 23. The containers 1 are fixedly secured on the receiving plate 23 by the centering head 24 and held in this position by the applied friction force or by another formfitting connection. At the same time, the position detent 16 opens, controlled by a cam, and moves the positioning finger 20 into a position distal from the center.

This concludes the transfer of the container 1. The aligned container 1 is then transported on the driven carousel 4 to the driven and rotating pressure head 6, 6'.

Each container 1 is accelerated, either by a separate drive or by the carrier conveyor 10, in the region of the pressure head 6, 6' to a circumferential velocity matching the velocity of the carrier conveyor 10. The identical spacing and the identical circumferential velocity of the container 1 on the carousel 4 and of the transfer rollers 26, 31 on the pressure head 6, 6' bring an aligned container 1 in contact with a respective transfer roller 26, 31. With this arrangement, a decor provided by the revolving carrier conveyor 10 can be reliably placed between the contacting transfer roller 26, 31 and the container 1.

When the pressure head 6 transfers the decor in a manner described with reference to the first embodiment, the transfer roller 26 rolls on the rotating container 1 and simultaneously follows the rotation of the container 1 over a common path while maintaining contact with the container 1.

The decor is transferred from the carrier conveyor 10 to the container 1 using the spring force provided by the cams 29 and the heat applied earlier to the carrier conveyor 10. Simultaneously, a pressure of blast air is established inside the container 1.

The conventional parallelogram-type motion of the pressure head 6 follows the contact line between the container 1 and the transfer roller 26 which moves in a radial direction due to the non-cylindrical shape of the container 1. With this arrangement, the contacting transfer roller 26 continuously contacts the non-cylindrical wall of the container 1 over a predetermined time interval equal to the transfer time.

The decor may become distorted as a result of the non-cylindrical shape of the container 1, which causes the circumferential velocity of the container 1 to vary in the contact region of the transfer roller 26.

Such distortions may be compensated in a conventional manner either by a suitable design of the decor, or by driving the container 1 separately in a non-uniform fashion, or by driving the carrier conveyor 10 in a non-uniform fashion, matching the circumferential velocity of the container 1.

According to the second embodiment, the pressure head 6' transfers the decor in a different fashion.

To establish contact, the transfer roller 31 moves from the circular path of the pressure head 6' to a circular path extending parallel to the transport path 5. This establishes a desired contact between the container 1 and transfer roller 31 which is maintained over a predetermined time. In the region of the common travel path of the container 1 and the transfer roller 31, the piston-cylinder unit pivots in such a way that the piston is always oriented perpendicular to the container 1. With non-cylindrical containers 1, the contact between the container 1 and the transfer roller 31 is maintained by having the pressure-controlled piston of the piston-cylinder unit follow the surface contour of the container 1.

To transfer the decor, the transfer roller 31 rolls on the rotating container 1 and simultaneously follows the travel of the container 1 over the common path while maintaining contact with the container 1.

The decor is transferred from the carrier conveyor 10 to the container 1 using the pressing force exerted by the pressing unit 33 and the heat stored in the carrier conveyor 10. The cam controllably changes the direction of the pressing unit 33 so that the pressing force is always applied perpendicular to the container 12.

The radial movement of the pressure-biased piston of the pressing unit 33 compensates the radial displacement of the contact line between the container 1 and the transfer roller 31 which occurs during the transfer and is caused by the non-cylindrical shape of the container 1. The cam controls the alignment of the pressing unit 33 so that the contacting transfer roller 31 is in continuous contact with the non-cylindrical wall of the container 1. The pressing force is always applied perpendicular during a predetermined time period which is equal to the transfer time.

When the pressure head 6, 6' leaves the contact and transfer region, all containers 1 pass by the thermal post-treatment unit 7 and are transferred by the discharge star 8 to the discharge conveyor 9.

What is claimed is:

1. A method of decorating containers, comprising:

feeding containers onto a moving transport path, the containers being stationary relative to said transport path and in a predetermined angular orientation;

transporting decals at a constant velocity on a carrier conveyor in a direction opposite said moving transport path and tangentially to a transfer location;

rotating the containers upon reaching said transfer location at a circumferential velocity equal to the constant velocity of the carrier conveyor; and transferring the decals sequentially to the containers at said transfer location by applying pressure and heat;

wherein the transferring step is performed by establishing a line of contact between the carrier conveyor and a rotating container via a freely rotating transfer roll of a pressure head, the transfer roll traveling alongside the rotating container and being movable transversely of said transport path during transfer of a decal to said rotating container, wherein said predetermined angular orientation of said containers is achieved by rotating and orienting the containers via a separate drive, and stopping rotation of said containers at said predetermined angular orientation prior to said feeding step, wherein said rotating and orienting comprises rolling a cylindrical portion of a rotating container on a stationary friction element over a predetermined rotation angle, wherein said rotating and orienting comprises securing containers on a feed star disposed upstream of a carousel defining the moving transport path, and transferring the oriented containers to rotatable receiving devices of the carousel, and wherein the containers are secured on the carousel by a friction force and wherein each receiving device is driven by the carrier conveyor against the friction force at said transfer location.

2. A method of decorating containers, comprising:

feeding containers onto a moving transport path, the containers being stationary relative to said transport path and in a predetermined angular orientation;

transporting decals at a constant velocity on a carrier conveyor in a direction opposite said moving transport path and tangentially to a transfer location;

rotating the containers upon reaching said transfer location at a circumferential velocity equal to the constant velocity of the carrier conveyor; and transferring the decals sequentially to the containers at said transfer location by applying pressure and heat;

wherein the transferring step is performed by establishing a line of contact between the carrier conveyor and a rotating container via freely rotating transfer roll of a pressure head, the transfer roll traveling alongside the rotating container and being movable transversely of said transport path during transfer of a decal to said rotating container; and wherein said freely rotating transfer roll, after application of a decal to a container, is returned to its initial position by a rotating motion about a pivot point located outside said moving transport path.

3. The method according to claim 2, further comprising a step of compensating for differences in circumferential velocity of the containers by matching either the rotation of the container or the transport motion of the carrier conveyor to the circumferential contour of the containers.

4. The method according to claim 2, wherein, for compensating for a different circumferential velocity of the containers, the decals on the carrier conveyor have a distortion which is matched to the circumferential contour of the container.

5. An apparatus for decorating containers, comprising:

a transport path for containers to be received thereon at a uniform spacing;

a carrier conveyor for transporting decorations having a uniform spacing;

the transport path and the carrier conveyor contacting each other with opposite rotational directions at a transfer location; and a pressure head for urging the carrier conveyor toward a container carried by the transport path at the transfer location; wherein the transport path comprises a thermalpost-treatment device located downstream of the transfer location and wherein the carrier conveyor includes a heating device located upstream of the transfer location;

the transport path further comprising rotatable receiving devices for receiving and securing the containers and a positioning device provided with a rotary drive and a position detent that matches with a marking on the containers and interrupts rotation of the containers;

each receiving device being rotatable together with a container carried therein at the transfer location in the direction of the carrier conveyor, and wherein the pressure head is provided with a pressure-biased movable transfer roller that rotates and travels alongside a container during application of a decoration, and which is movable transversely of the transport path during application of a decoration, wherein the pressure head is rotatable and driven in the direction of travel of the transport path, and wherein the transfer rollers are arranged on a circular track of the pressure head and are operatively interconnected by a pressing unit, the pressing unit being pivotable about a pivot point located outside the axis of rotation of the pressure head and supported for radial displacement relative to a rail which is pivotable about said pivot point, wherein said pivoting and displacement motion has separate drives in the transfer location, and wherein the pressing unit is driven by a cam gear to provide said pivoting and displacement motion for adjusting a circular path of the transfer roller, and wherein the pressing unit is driven by a pressure medium so as to adapt said displacement motion to a surface contour of the containers.

6. The apparatus according to claim 5, wherein the pressing unit is a piston-cylinder unit.

7. The apparatus according to claim 6, wherein each transfer roller is associated with a pressing unit which rotates together with the pressure head.

8. The apparatus according to claim 6, wherein a single stationary pressing unit is associated with all of said transfer rollers, and wherein said stationary pressing unit is driven in the transfer location by rotating motion of the rotating pressure head, so as to move together with the containers at the transfer location, and wherein the stationary pressing unit has a separate drive for return travel.

9. The apparatus according to claim 8, wherein the transfer rollers are spaced apart on an annular path of the pressure head by retaining elements which are also formed as guide elements and optionally as heating elements for the carrier conveyor.

10. An apparatus for decorating containers, comprising:

a transport path for containers to be received thereon at a uniform spacing;

a carrier conveyor for transporting decorations having a uniform spacing;

the transport path and the carrier conveyor contacting each other with opposite rotational directions at a transfer location; and a pressure head for urging the carrier conveyor toward a container carried by the transport path at the transfer location; wherein the transport path comprises a thermalpost-treatment device located downstream of the transfer location and wherein the carrier conveyor includes a heating device located upstream of the transfer location;

the transport path further comprising rotatable receiving devices for receiving and securing the containers and a positioning device provided with a rotary drive and a position detent that matches with a marking on the containers and interrupts rotation of the containers;

each receiving device being rotatable together with a container carried therein at the transfer location in the direction of the carrier conveyor, and wherein the pressure head is provided with a pressure-biased movable transfer roller that rotates and travels alongside a container during application of a decoration, and which is movable transversely of the transport path during application of a decoration;

wherein the pressure head is rotatable and driven in the direction of transport travel of the transport path, and comprises at least three transfer rollers each of which is supported above a piston cylinder unit at a pivot point located outside the transport path, the transfer rollers being interconnected via articulated arms, and wherein a spacing between adjacent transfer rollers corresponds to a spacing between containers on the transport path.

11. The apparatus according to claim 10, wherein four transfer rollers are combined to form a movable parallelogram.

12. The apparatus according to claim 11, wherein the pressure head further comprises a stationary cam having a shape complimentary to a contour of the containers being decorated, the stationary cam biasing one of the transfer rollers acting on a container at the transfer location.

13. The apparatus according to claim 10, wherein the articulated arms are in the form of heating plates for the carrier conveyor.

* * * * *